US005518421A

United States Patent [19]

Davis

[11] Patent Number: 5,518,421

[45] Date of Patent: May 21, 1996

[54] TWO PIECE SHELL FOR A CONNECTOR

[75] Inventor: Wayne S. Davis, Harrisburg, Pa.

[73] Assignee: The Whitaker Corporation, Wilmington, Del.

[21] Appl. No.: 8,926

[22] Filed: Jan. 26, 1993

[51] Int. Cl.[6] ..... H01R 13/648

[52] U.S. Cl. ..... 439/607; 439/610

[58] Field of Search ..... 439/101, 108, 439/607, 609, 610

[56] References Cited

U.S. PATENT DOCUMENTS

| | | | |
|---|---|---|---|
| 3,760,335 | 9/1973 | Roberts . | |
| 4,453,798 | 6/1984 | Asick et al. . | |
| 4,585,292 | 4/1986 | Frantz et al. . | |
| 4,653,836 | 3/1987 | Peele . | |
| 4,889,503 | 12/1989 | Philippson | 439/610 |
| 4,900,277 | 2/1990 | Inaba et al. | 439/752 |
| 4,917,629 | 4/1990 | Matsuzaki et al. | 439/607 X |
| 4,929,195 | 5/1990 | Seidoh | 439/610 |
| 4,974,075 | 11/1990 | Nakajima | 439/607 X |
| 4,981,447 | 1/1991 | Ichitsubo | 439/607 |
| 5,030,114 | 7/1991 | Carey et al. | 439/92 |
| 5,073,130 | 12/1991 | Nakamura | 439/607 |
| 5,087,210 | 2/1992 | Myers et al. | 439/607 X |
| 5,088,932 | 2/1992 | Nakamura | 439/350 |
| 5,092,794 | 3/1992 | Kachlic | 439/607 |
| 5,158,481 | 10/1992 | Frantz | 439/607 |
| 5,171,161 | 12/1992 | Kachlic | 439/352 |
| 5,180,316 | 1/1993 | Miller et al. | 439/607 X |
| 5,222,909 | 6/1993 | Nomura et al. | 439/607 |

FOREIGN PATENT DOCUMENTS

| | | |
|---|---|---|
| 0338727 | 4/1989 | European Pat. Off. . |

*Primary Examiner*—Khiem Nguyen

[57] ABSTRACT

Shielding (36) for an electrical connector (1), comprises; two conductive, telescopic shells (37, 38) that fit and slide one within the other, the shielding (36) has locks (48) on at least one of the shells (37) to lock to an electrical connector (1), to resist shifting of the connector (1) relative to a mating end (41) of the shielding (36), the first shell (37) is formed with both the mating end (41) a deformable portion (51) of a strain relief at opposite ends of a tongue (58), and the tongue (58) extends along the second shell (38) from front to rear.

19 Claims, 6 Drawing Sheets

TWO PIECE SHELL FOR A CONNECTOR

FIELD OF THE INVENTION

The present invention relates to a conductive shell for a connector, and particularly, to a conductive shell and the manner by which the shell is assembled onto an electrical connector to provide EMI and EMF shielding.

BACKGROUND OF THE INVENTION

There is disclosed in U.S. Pat. No. 5,158,481, a shielded electrical connector comprising; a terminal support block, contact terminals supported on the block for connection to wires, and shielding for the connector comprising; a mating end on a front shell encircling a mating end of the terminal support block, conductive backshells enveloping the block, and a deformable strain relief on the backshells.

The backshells close together similarly as do mating halves of a clamshell, and fit one within another. The front shell is fabricated as a seamless drawn tube with an exact profile to conform to the shape of a mating electrical connector. The profile must be free of distortion, especially as distortion may occur when a strain relief on the shielding is subject to deformation to grip an electrical cable. The front shell, being a separate drawn part, is isolated from the deformable strain relief on the backshells.

The front shell requires a somewhat elaborate connection to the backshells, described as follows. The backshells and front shell are assembled by hooks passing through slots in the front shell. Compression beams near the hooks press against the front shell to establish electrical continuity between the front shell and the backshells.

In such a connector as described in U.S. Pat. No. 3,760, 335, care must be taken to prevent shifting of the terminal support block, accompanied by the contact terminals, relative to the front shell, especially while the connector undergoes mating connection with another, mating electrical connector. During mating connection, the contact terminals of the mating connectors engage and wipe against one another, advantageously cleaning the terminals of oxides and other contaminants that would cause an undesired voltage drop across the surfaces of the contact terminals. Shifting of the terminal block during the course of mating connection decreases the stroke of contact wiping that advantageously cleans the contact terminals.

SUMMARY OF THE INVENTION

According to features of the invention, shielding for an electrical connector is constructed of two telescopic shells that fit and slide one within the other, wherein one of the shells envelops a seam in the other shell by telescopic fit to resist widening of the seam, and at least one of the shells of the shielding locks to the connector to resist shifting of the connector relative to the shielding. By locking to a connector, the shielding prevents shifting of a mating end of the connector relative to a mating end of the shielding, especially during mating connection of the connector with another, mating connector. A telescopic shell resists widening of a seam in the other shell, which resists distortion of the other shell.

According to another feature of the invention, the first and second shells interlock with one another along both sides of the seam, to resist widening of the seam.

According to another feature of the invention, a one piece shell is formed with both a mating end of the shielding and a deformable strain relief at opposite ends of a tongue. The mating end is isolated from the deformable strain relief by the tongue extending from front to rear along the second shell.

DESCRIPTION OF THE DRAWINGS

An embodiment of the invention will now be described, by way of example, with reference to the accompanying drawings, according to which.

An electrical connector, known from U.S. Pat. No. 3,760, 335, comprises, an insulating housing and conductive signal contacts. The contacts are grouped in pairs, with an insulative divider of the housing separating one contact of the pair from the other contact of the pair. Multiple pairs of the contacts are distributed along the insulative divider.

Figure 1:
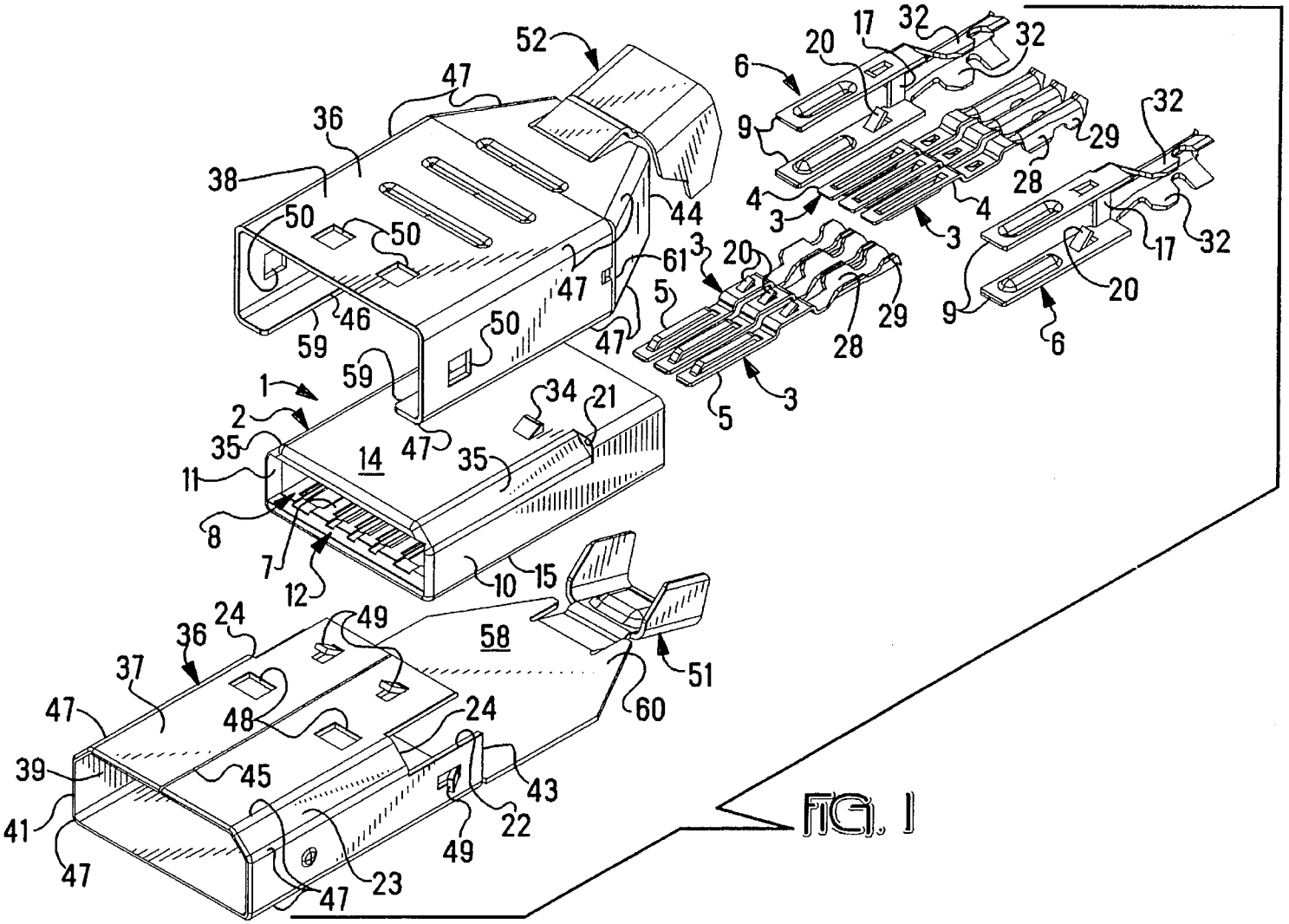
FIG. 1 is a perspective view of a shielding and an electrical connector with parts separated from one another.
Figure 8:
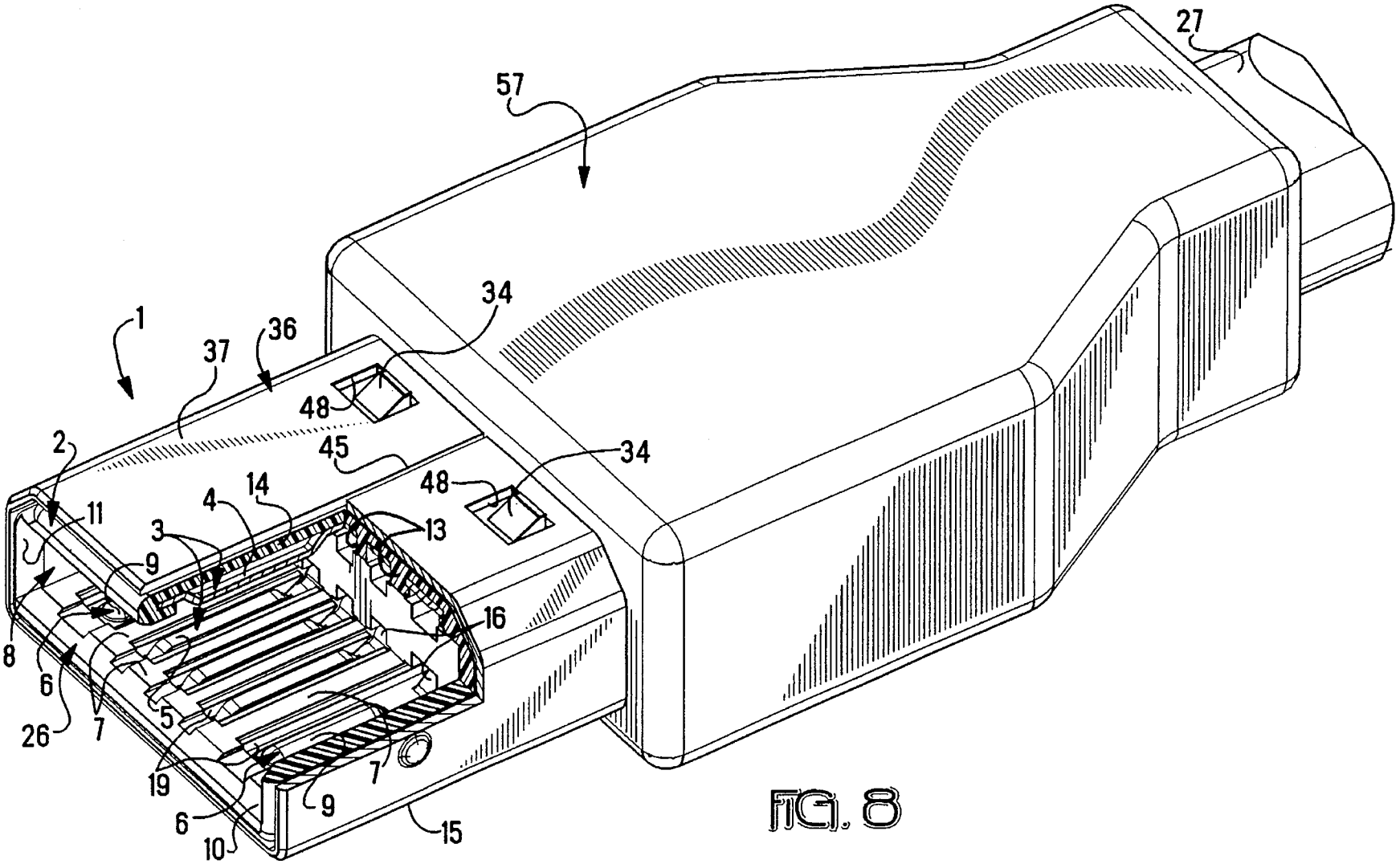
FIG. 8 is a perspective view of the shielding and connector together with an overmold.

With reference to FIGS. 1 and 8, an electrical connector 1 comprises, an insulative housing 2, and multiple pairs 3 of conductive signal contacts 4, 5 in the housing 2. Such a connector 1 may comprise solely signal contacts 4, 5 is disclosed in U.S. Pat. No. 3,760,335, wherein, the pairs of contacts are especially suitable for connection to conductors, such as, twisted pair wires used in the communications industry for data and voice transmission. Each pair of the twisted pair wires is connected to one pair of the contacts.

Such a connector 1 may comprise the signal contacts 4, 5, accompanied by at least one power contact 6, in the housing 2. The pairs 3 of the signal contacts 4, 5 are distributed along an insulative divider 7 in an interior 8 of the housing 2. The signal contacts 4, 5 of each pair 3 are on opposite sides of the divider 7 that separates the signal contacts 4, 5 of each pair 3. The signal contacts 4, 5 are in rows, and are parallel to one another. A pair of contact fingers 9 on the power contact 6 are on opposite sides of the divider 7, and extend parallel to the signal contacts 4, 5. The surface area of each of the fingers 9 is larger than that of each of the signal contacts 4, 5, and is sufficiently broad to radiate heat from electrical power dissipation. In addition, each of the fingers 9 is of greater mass than each of the signal contacts 4, 5 to carry electrical current. When electrical current is transmitted via the power contact 6, dissipation of electrical power generates heat. The heat is radiated from the surface area of the power contact 6. A larger surface area and a higher mass of the power contact 6 will limit the temperature attained by the power contact 6.

The divider 7 bridges between, and is joined to side walls 10, 11 of the housing 2. The divider 7 extends from a front mating end 12 of the housing 2 and rearwardly in the interior 8 of the housing 2. Spaced apart partitions 13 in the interior 8 bridge between the divider 7 and a top wall 14 of the housing 2, and between the divider 7 and a bottom wall 15 of the housing 2. The partitions 13 join the divider 7 and the top and bottom walls 14, 15o The walls 14, 15 bridge between and join the side walls 10, 11 to form the exterior of the housing 2. Contact receiving cavities 16 in the housing 2 are defined between the partitions 13 and extend behind the divider 7 to receive the signal contacts 4, 5. With respect to the power contact 6, FIG. 1, the fingers 9 are connected to a body portion 17 having a surface area sufficiently broad to radiate heat from electrical power dissipation. The divider 7 extends forwardly of the partitions 13, and is provided with a series of grooves 19 on its opposite sides aligned with the contact receiving passages. The grooves 19 receive the signal contacts 4, 5 and the contact fingers 9. The grooves 19 that receive the contact fingers 9 are larger than the grooves 19 that receive the signal contacts 4, 5. Projecting lances 20 on each signal contact 4, 5 and on the power contact 6 impinge against walls, not shown, of the housing 2, and resist withdrawal of the contacts 4, 5 and 6 from the grooves 19. Each of the signal contacts 4, 5 and the power contact 6 is of unitary construction, stamped and formed from a strip of metal.

With reference to FIGS. 1–8, a cable connector 1 will be described. The divider 7 of the cable connector 1 is bifurcated by a passage 26 at the front mating end 12 for receiving a portion of a mating connector, not shown. The grooves 19 face toward the passage 26, such that the contacts 4, 5 on opposite sides of the divider 7 face toward the passage 26. The pairs 3 of signal contacts 4, 5 are adapted to be connected to respective pairs 3 of conductors 27 of a single electrical cable 25, or of multiple electrical cables, not shown. The signal wires can be a twisted pair of signal wires. In FIG. 1, each of the signal contacts 4, 5 further comprises a termination 22 having arms 28 that extend outward laterally of each other, the arms being bendable into an open barrel configuration to encircle and connect with the conductor 27. Another set of arms 29 extend laterally of each other, the arms 29 being bendable into an open barrel configuration to encircle and connect with insulation encircling the conductor 27.

Figure 3:
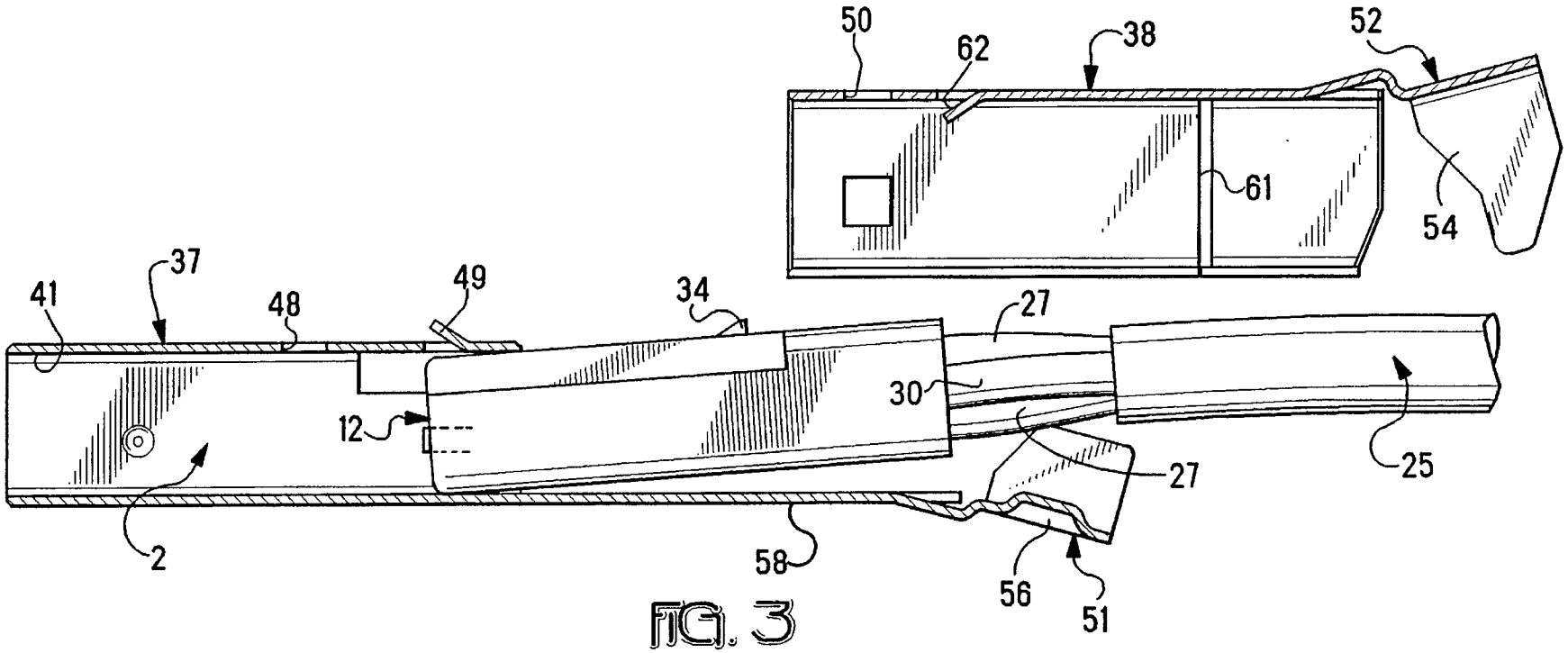
FIG. 3 is a longitudinal section view of the shielding and connector as shown in FIG. 1 with parts partially assembled.
Figure 4:
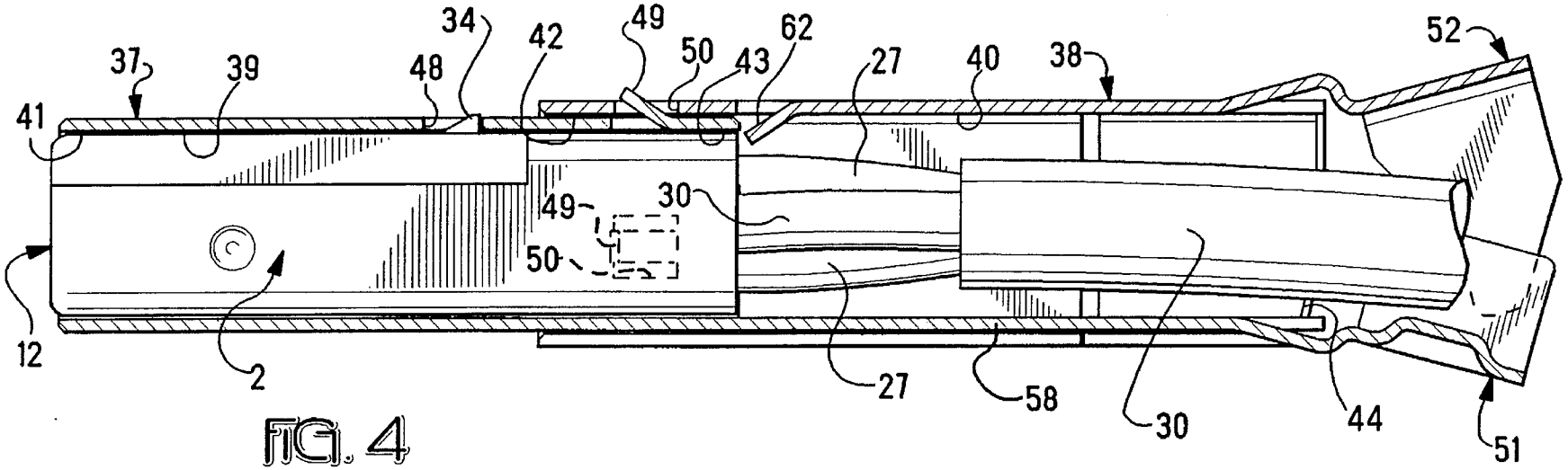
FIG. 4 is a view similar to FIG. 3 with the parts assembled together.
Figure 5:
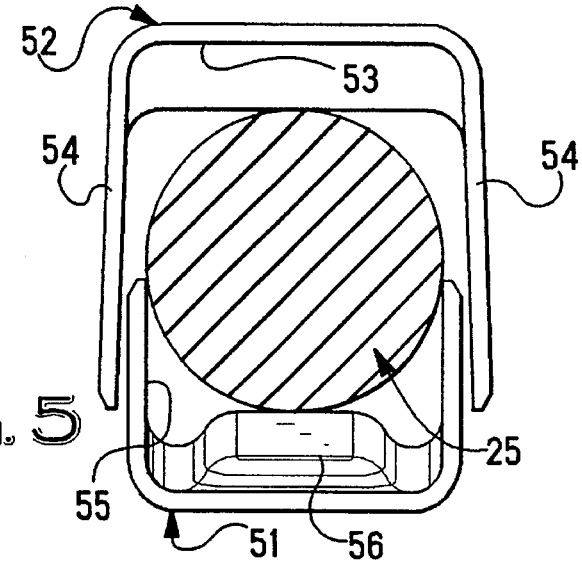
FIG. 5 is a section view of strain relief portions of the shielding shown in FIG. 4.
Figure 6:
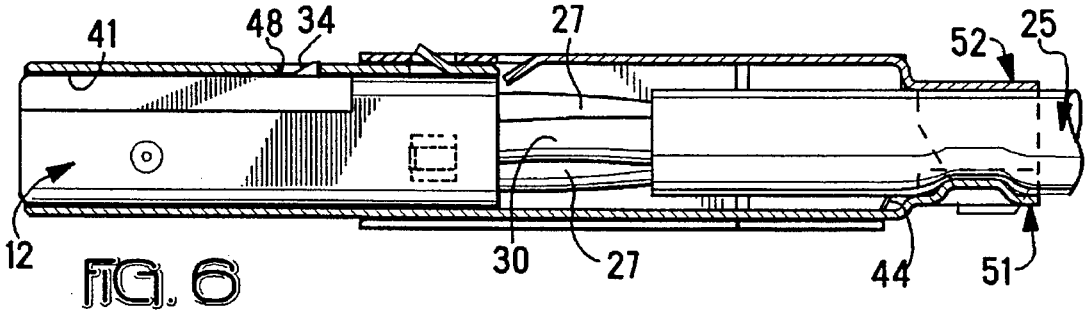
FIG. 6 is a view similar to FIG. 4 with the strain relief portions gripping an electrical cable.
Figure 7:
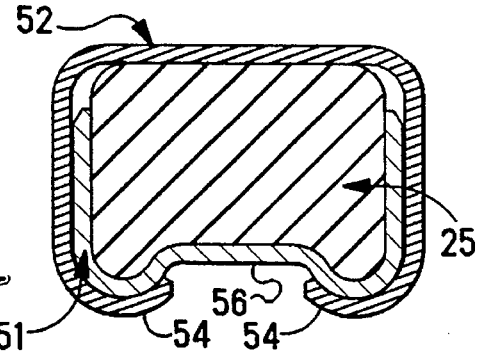
FIG. 7 is a section view of the strain relief portions as shown in FIG. 6.

With reference to FIGS. 3, 4 and 6, the contact fingers 9 extend from a connection to an electrical power transmitting conductor or wire 30, larger in diameter than each of the signal wires 27, of the cable 25. In particular, the body portion 17 comprises a termination 22 having sets of arms 32, 33 that extend outward laterally of each other, the arms 32 being bendable into an open barrel configuration to encircle and connect with the electrical power transmitting wire 30. The power transmitting wire 30 is larger in diameter than each of the signal wires 27 to carry electrical current. The signal wires 27 are smaller in diameter, as they are required to transmit electrical signals of which the voltage, not the electrical power, is of paramount importance. The set of arms 33 extend laterally of each other, and are bendable into an open barrel configuration to encircle and connect with insulation encircling the power transmitting wire 30.

With reference to FIGS. 1 and 8, projecting locks 34 are on the exterior of the wall 14. The locks 34 are in the form of inclined wedge projections tapering toward the front mating end 12. The mating end 12 has a profile including chamfers 35 that intersect the wall 14, making the wall 14 less wide than the wider wall 15, thereby providing the connector 1 with polarity for orienting the mating end 12. The chamfers 35 extend rearward and end against front facing shoulders 21 on jutting corners of the housing 2.

Figure 2:
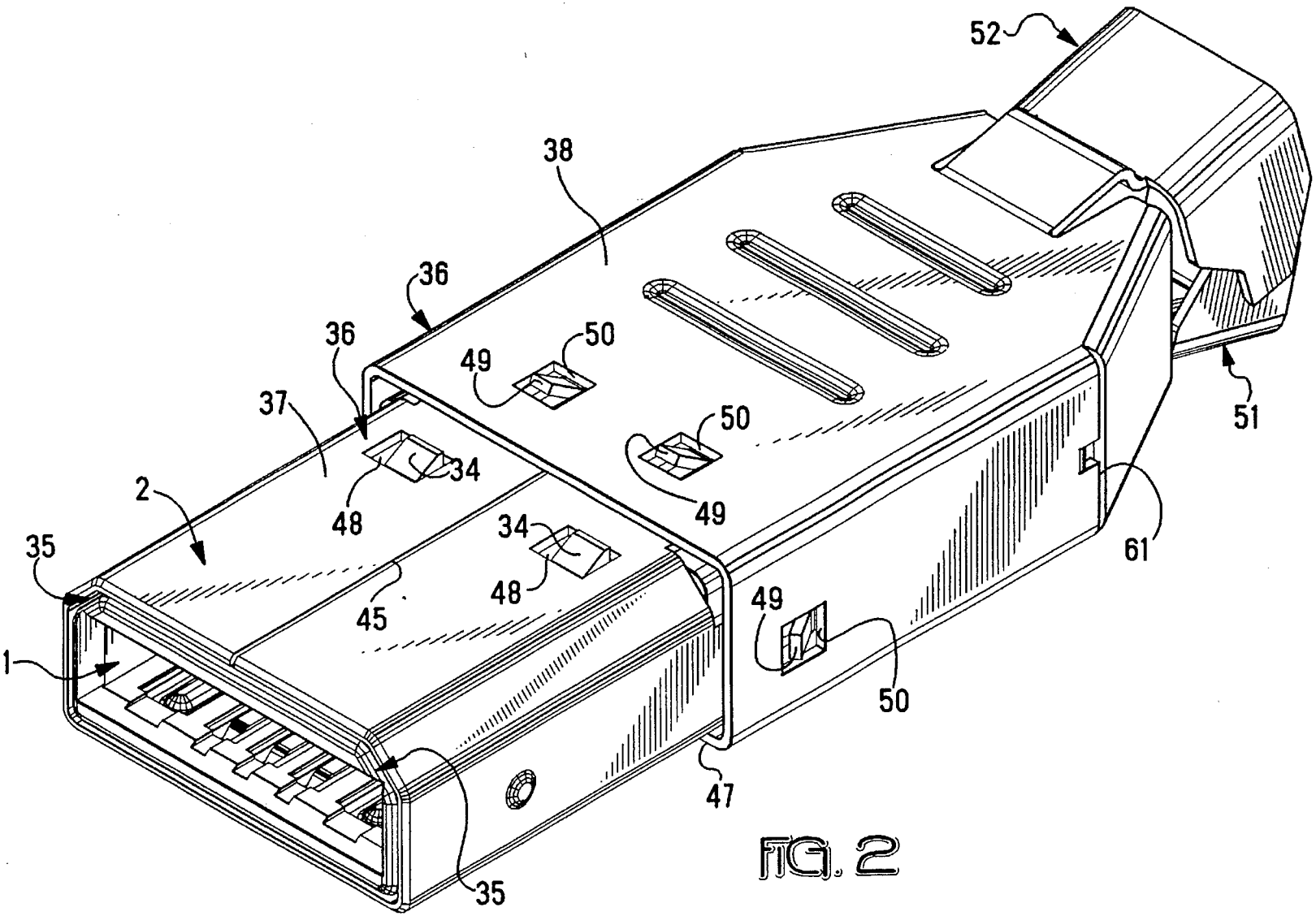
FIG. 2 is a perspective view of the shielding and connector shown in FIG. 1.

With reference to FIGS. 1 and 2, shielding 36 for the electrical connector 1, comprises; two conductive, telescopic shells 37, 38 that fit and slide one within the other. Each of the shells 37, 38 is of unitary construction, stamped and formed from a metal plate. The shells 37, 38 each are bent on themselves, forming wrapped sections, and forming telescopic first and second tubular enclosures 39, 40, with open front ends 41, 42 and open rear ends 43, 44, which fit slidably one within another. A longitudinal seam 45 in the enclosure 39 of the first shell 37 intersects and extends through the front and rear ends 41 and 43. A similar longitudinal seam 46 in the enclosure 40 intersects and extends through the front and rear ends 42 and 44. The seam 46 of the second shell 38 is open, by a substantial width. The seam 45, 46 of each enclosure 39, 40 is opposite a seamless wall of the same enclosure 39, 40. The seam 45, 46 of each enclosure 39, 40 fits slidably telescopic against the seamless wall of the other enclosure 39, 40. The open front end 41 on the first shell 37 is the mating end of the shielding 36. The seam 45 in the first shell 37 is enveloped by the second shell 38 by telescopic fit to resist widening of the seam 45, and consequent deformation of the mating end 41. Such deformation is undesired, for it would create frictional resistance to mating connection of the connector 1 to another, mating connector, and would resist conforming fit of the shielding 36 with and against shielding on the mating connector.

A number of folds 47 in the tubular enclosure 39 conform to a chamfered exterior shape of the housing 2 of the connector 1. The folds 47 define the circumference of the profile on the mating end 41. Notches 22 extend forwardly from the rear end 43 and in alignment with chamfers 23 defined by the folds 47. The notches 22 end in rear facing shoulders 24. Folds 47 in the enclosure 40 define the circumferences of the open ends 42, 44. The folds 47 conform the shell 38 with the shape of the first shell 37.

Multiple locks 48, in the form of openings, located on both sides of the seam 45, lock to the connector 1 by locking to the projecting locks 34 on the housing 2. As shown in FIG. 3, the cable 25 is terminated with the connector 1, and the connector 1 is inserted into the open rear end 43 of the first enclosure 39, and is slidable along the enclosure 39 until the projecting locks 34 on the housing 2 emerge in, and lock with, the locks 48 of the first shell 37, FIG. 4. The first shell 37 locks onto the connector 1, to resist shifting of the connector 1 rearward relative to a mating end 41 of the shielding 36, especially during mating connection of the connector 1 with another, mating connector. The front facing shoulders 21 face the rear facing shoulders 24 to resist further forward movement of the housing 2 relative to the shell 37. The first shell 37 locks onto the housing 2 on both sides of the seam 45, further to resist widening of the seam 45.

The first and second shells 37, 38 interlock with one another along both sides of the seam 45, to resist widening of the seam 45. Projecting locks 49 on the exterior of the enclosure 39 of the first shell 37 are in the form of inclined wedge projections, having outlines cut from the shell 37, tapering toward the rear open end 43.

Locks 50, in the form of openings in the enclosure 40 of the second shell 38, are aligned with the locks 49 of the first shell 37. Deformable strain relief portions 51, 52 at rears of the first and second shells 37, 38 are deformable together to grip the cable 25. On the second shell 38, the strain relief portion 52 comprises, a channel 53 with clamping fingers 54 extending from a base of the channel 53. On the first shell 37, the strain relief portion 51 comprises, a channel 55 with an external indentation 56 in a base of the channel 55. The deformable strain relief portions 51, 52 initially are bent obliquely outward, FIGS. 2 and 3, providing clearance to receive the cable 25 in both channels 53, 55 that overlap each other, FIG. 5. The strain relief portions 51, 52 are straightened, FIG. 7 to clamp the cable 25 and reshape the cross section of the cable 25 to fit and conform within the channels 53, 55. The clamping fingers 54 are closed toward each other and enter the indentation 56. Then, an overmold 57, FIG. 8, in the form of a molded insulation of desired shape, covers and adheres to the cable 25 and the strain relief portions 51, 52.

On the first shell 37, the mating end 41 and a deformable strain relief portion 51 are connected at opposite ends of an interposed tongue 58. The tongue 58 separates the enclosure 39 from the strain relief portion 51, and isolates the enclosure 39 from distortion which might result because of deformation of the strain relief portion 51. The first shell 37 provides both, a deformable portion 51 of the strain relief subject to being deformed over a cable 25, and a mating end 41 at a front of the shielding 36 having a shaped profile that remains undistorted by deformation of the deformable portion 51, due to the interposed tongue 58.

The tongue 58 extends along the second shell 38 from front to rear. Further, the tongue 58 extends inside the second shell 38, and covers the open seam 46 of the second shell 38. The tongue 58 tapers toward the rear to a narrow section 60 adjacent to the strain relief portion 51. Flanges 59 on the second shell 38 face each other across the seam 46 and overlap the tongue 58. The flanges 59 each are notched at 61, which allows the flanges 59 to change direction and converge toward each other adjacent to the strain relief portion 52, thereby, tapering the width of the open seam 46. The narrow section 60 is narrower that the width of the open seam 46 at the front of the second shell 38. The second shell 38 is assembled to the first shell 37, first by inserting the narrow section 60 into the front of the open seam 45, then, sliding the flanges 59 over the narrow section 60 and forwardly. The converging portions of the flanges 59 overlap the tapered tongue 58, and resist further forward movement of the rear shell 38. The enclosures 39, 40 of the shells 37, 38 slidably fit one into the other. The projecting locks 49 of the first shell 37 enter and lock with the locks 50 of the second shell 38, and resist rearward movement of the second shell 38. The second shell 38 has inward projecting tabs 62, FIG. 4, having outlines cut from the shell 38, that engage behind the rear end 43 of the first shell 37 to resist rearward movement of the first shell 37. Thereby, the shells 37, 38 lock to each other.

Other advantages, and other embodiments and modifications of the invention are intended to be covered by the spirit and scope of the accompanying claims.

I claim:

1. Shielding for an electrical connector comprising: first and second conductive shells adapted to fit and slide telescopically one within the other to encircle an electrical connector and a cable terminated with the electrical connector, on at least one of said shells a strain relief to grip an electrical cable, the first shell having a mating end and a tongue, the second shell having a front end and an open seam to be covered by the tongue, the front end and a rear of the mating end being adapted to fit and slide telescopically one within the other, front to rear, and flanges on the second shell facing the open seam and adapted to fit and slide telescopically over the tongue.

2. Shielding as recited in claim 1, and further comprising: the mating end comprising an enclosure adapted to encircle an electrical connector, and the enclosure and the front end adapted to fit and slide telescopically one within the other.

3. Shielding as recited in claim 1, and further comprising: the flanges being adapted to fit and slide telescopically with the rear of the mating end.

4. Shielding as recited in claim 1, and further comprising: the shells being adapted to interlock on both sides of a seam in the first shell to resist widening of the seam.

5. Shielding as recited in claim 1, and further comprising: a seam in the first shell extending through the mating end, a seamless wall of the second shell adapted to envelop the seam when the shells fit and slide telescopically, and the shells being adapted to interlock with one another on both sides of the seam to resist seam widening.

6. Shielding as recited in claim 1, and further comprising: a seam in the first shell extending through the mating end, and the shells being adapted to interlock with one another on both sides of the seam to resist seam widening.

7. Shielding as recited in claim 1, and further comprising: first and second strain relief portions on respective said shells together providing said strain relief.

8. Shielding as recited in claim 1, and further comprising: the strain relief portions being mounted pivotally on respective shells to pivot toward each other.

9. Shielding for an electrical connector comprising: a first shell having a mating end and a tongue, a second shell having three sides and an open seam, on at least one of said shells a strain relief to grip an electrical cable, and both a rear of the mating end and the tongue telescopically fitting and sliding, front to rear, within the second shell to cover the open seam, and to encircle an electrical connector and an electrical cable terminated with the electrical connector.

10. Shielding as recited in claim 9, and further comprising: flanges on the second shell facing the open seam and adapted to fit and slide telescopically over the tongue.

11. Shielding as recited in claim 9, and further comprising: a seam in the first shell extending through the mating end, a seamless wall on the second shell adapted to envelop the seam, and the shells being adapted to interlock with one another on both sides of the seam to resist seam widening.

12. Shielding as recited in claim 9, and further comprising: locks on the shells to interlock the shells and resist widening of a seam in the first shell.

13. Shielding as recited in claim 9, and further comprising: a seam extending through the mating end, and the shells being adapted to interlock with one another on both sides of the seam to resist seam widening.

14. Shielding as recited in claim 9, and further comprising: first and second strain relief portions on respective said shells together providing said strain relief.

15. Shielding as recited in claim 14, and further comprising: the strain relief portions being mounted pivotally on respective shells to pivot toward each other.

16. Shielding as recited in claim 9, and further comprising: the mating end comprising an enclosure adapted to encircle an electrical connector.

17. Shielding as recited in claim 16, and further comprising: multiple locks on the enclosure to lock onto an electrical connector, a seam extending through the enclosure, and the shells being adapted to interlock with one another on both sides of said seam to resist seam widening.

18. Shielding for an electrical connector, comprising: first and second conductive shells that fit and slide telescopically one within the other, front to rear, the first shell having a mating end adapted to receive an electrical connector, a tongue extending rearward of the mating end, the second shell having an open seam and flanges facing the open seam that fit and slide telescopically, progressively, first with the tongue, and second with a rear of the mating end, a seam in the first shell extending through the mating end, a seamless wall on the second shell adapted to envelop the seam, and the shells being adapted to interlock with one another on both sides of the seam to resist seam widening.

19. Shielding for an electrical connector, comprising: first and second conductive shells that fit and slide telescopically one within the other, front to rear, the first shell having a mating end adapted to receive an electrical connector, a tongue extending rearward of the mating end, the second shell having an open seam and flanges facing the open seam that fit and slide telescopically, progressively, first with the tongue, and second with a rear of the mating end, a seam in the first shell extending through the mating end, and the shells being adapted to interlock with one another on both sides of the seam to resist seam widening.

* * * * *